US008215021B2

(12) United States Patent
Seber et al.

(10) Patent No.: US 8,215,021 B2
(45) Date of Patent: Jul. 10, 2012

(54) TOOL INCLUDING A LOCKING MECHANISM

(75) Inventors: Brett P. Seber, Vista, CA (US); Wesley James Tom, Escondido, CA (US)

(73) Assignee: Seber Design Group, Inc., Vista, CA (US)

( * ) Notice: Subject to any disclaimer, the term of this patent is extended or adjusted under 35 U.S.C. 154(b) by 411 days.

(21) Appl. No.: 12/369,611

(22) Filed: Feb. 11, 2009

(65) Prior Publication Data

US 2009/0223061 A1 Sep. 10, 2009

Related U.S. Application Data

(60) Provisional application No. 61/027,786, filed on Feb. 11, 2008, provisional application No. 61/144,436, filed on Jan. 13, 2009.

(51) Int. Cl.
*B26B 1/04* (2006.01)

(52) U.S. Cl. ..... 30/161; 30/155

(58) Field of Classification Search ..... 30/155–161, 30/519

See application file for complete search history.

(56) References Cited

U.S. PATENT DOCUMENTS

| | | | | | |
|---|---|---|---|---|---|
| 308,969 | A | | 12/1884 | Lussier | |
| 1,101,381 | A | | 6/1914 | Anderson et al. | |
| 1,203,685 | A | | 11/1916 | Baker | |
| 1,647,405 | A | * | 11/1927 | Giesen | 30/160 |
| 2,621,689 | A | * | 12/1952 | Fordon | 30/519 |
| 2,803,980 | A | | 8/1957 | Vogel | |
| 3,332,295 | A | | 7/1967 | Cummings et al. | |
| 3,777,591 | A | * | 12/1973 | Thomasian | 74/576 |
| 4,730,394 | A | | 3/1988 | Sonner | |
| 4,893,409 | A | | 1/1990 | Poehlmann | |
| 4,918,820 | A | | 4/1990 | Korb et al. | |
| 5,325,588 | A | | 7/1994 | Rogers | |
| 5,327,651 | A | | 7/1994 | Favreau | |
| 5,425,175 | A | | 6/1995 | Rogers | |
| 5,661,908 | A | * | 9/1997 | Chen | 30/125 |
| 5,722,168 | A | | 3/1998 | Huang | |
| 5,839,194 | A | | 11/1998 | Bezold | |
| 5,915,792 | A | * | 6/1999 | Sakurai | 30/161 |
| 6,134,788 | A | | 10/2000 | Chen et al. | |
| 6,446,341 | B1 | | 9/2002 | Wang et al. | |
| 7,093,367 | B1 | | 8/2006 | Huang | |
| 7,162,803 | B2 | | 1/2007 | Lu | |
| 7,231,718 | B2 | | 6/2007 | Outen | |
| 2009/0223061 | A1 | * | 9/2009 | Seber et al. | 30/160 |
| 2010/0175267 | A1 | * | 7/2010 | Seber et al. | 30/156 |

* cited by examiner

*Primary Examiner* — Hwei C Payer

(74) *Attorney, Agent, or Firm* — Patterson & Sheridan, L.L.P.

(57) ABSTRACT

Aspects of the disclosure include a tool. The tool may include a working portion, e.g. a blade, and a holding portion, e.g., a blade holder, wherein the blade and the blade holder are coupled in such a manner that the blade may be positioned in a plurality of configurations with respect to the blade holder. The blade and blade holder may include one or more of an engagement element and/or engagement element receiver that are configured for being coupled together in such a manner that the blade is substantially prevented from moving relative to the blade holder. The blade and/or blade holder may include a plurality of engagement elements and corresponding engagement element receivers such that the blade is capable of being moved incrementally with respect to the blade holder. Also provided are methods of using the tool as well as specialized packaging for offering the tool for sale.

17 Claims, 10 Drawing Sheets

TOOL INCLUDING A LOCKING MECHANISM

CROSS REFERENCE TO RELATED APPLICATION

This application claims the benefit under 35 U.S.C. §119 (e) of the following provisional applications, all of which are incorporated herein by reference in their entirety: U.S. Ser. No. 61/027,786, entitled "Ratcheting Knife," filed Feb. 11, 2008; and U.S. Ser. No. 61/144,436, entitled "Tool Including A Locking Mechanism," filed Jan. 13, 2009.

BACKGROUND OF THE DISCLOSURE

Tools have been developed to facilitate the performance and/or completion of work. One type of tool Tools have been developed to facilitate the performance and/or completion of work. One type of tool is a knife. Knives are generally known in the art. Knives typically include a blade and a handle into which at least portion of the blade is fitted. The blade and handle of a knife can have several types of configurations. One type of knife configuration includes an elongated blade which is immovably fixed at one end to a handle, leaving the other end continuously exposed. Because the blade is continuously exposed, these types of knives can be dangerous, e.g., especially to store and/or transport. Another type of knife configuration includes a blade that is moveable with respect to the handle. Such knives have a blade that either slides or rotates from a retracted position, wherein the blade is received within the handle, to an extended position, wherein the blade is fully extended in an exposed position. Accordingly, these types of knives may be less dangerous, e.g., to store or transport, when the blade is retracted into the handle portion. In certain instances, such knives may have a locking mechanism wherein the blade may be locked in one or both of a retracted, closed position, or an open, fully extended position. Accordingly, there exist significant interests in the development of tools, e.g., including knives, that include both a working, e.g., a blade portion, and a handle portion, wherein the working portion and handle portion have a number of configurations with respect to one another. The presently described tools meet these and other such interests.

SUMMARY OF THE DISCLOSURE

Aspects of the disclosure include a tool. In certain instances the tool includes a working portion, such as a blade, and a holding portion, such as a blade holder, wherein the working portion and the holding portion are coupled in such a manner that the working portion may be positioned and held in place in a plurality of configurations with respect to the holding portion. For instance, in one embodiment, the blade may include one or more of an engagement element and/or an engagement element receiver and the blade holder includes one or more of a complementary engagement element receiver and/or engagement element, wherein the complementary engagement element and engagement element receiver are configured for being coupled together in such a manner that the blade is substantially prevented from moving relative to the blade holder. In certain instances, the blade and/or blade holder include a plurality of engagement elements and/or corresponding engagement element receivers, e.g., complementary teeth, such that the blade is capable of being moved incrementally with respect to the blade holder and/or then locked in place. For example, in certain embodiments of a tool of the disclosure, the working portion is a blade, and the holding portion is a blade holder, wherein the blade and the blade holder may be coupled together in such a manner that the blade is moveable incrementally with respect to the blade holder. Also provided is a method of using a tool of the disclosure as well as a specialized packaging for displaying and/or offering the blade for sale.

BRIEF DESCRIPTION OF THE DRAWINGS

According to common practice, the various features of the drawings may not be drawn to-scale. Rather, the dimensions of the various features may be arbitrarily expanded or reduced for clarity. Included in the drawings are the following figures:

FIG. 1 illustrates the knife in a closed configuration. FIG. 2 illustrates the knife in an open configuration. FIG. 3 illustrates the knife in a semi-open configuration.

FIG. 4 illustrates a top portion of the blade holder. FIG. 6 illustrates a thumb switch top. FIG. 7 illustrates a thumb switch bottom. FIG. 5 illustrates an embodiment that shows the knife of FIG. 1, with a top portion of the blade holder removed.

FIG. 8 illustrates the knife in a closed configuration. FIG. 9 illustrates the knife in a semi-open configuration. FIG. 10 illustrates the knife in an open configuration.

FIG. 16 illustrates a blade holder. FIG. 15 illustrates a pawl holder. FIG. 14 illustrates pawls and a spring. FIG. 13 illustrates a blade. FIG. 12 illustrates a selector plate. FIG. 11 illustrates a bushing.

Figure 1:
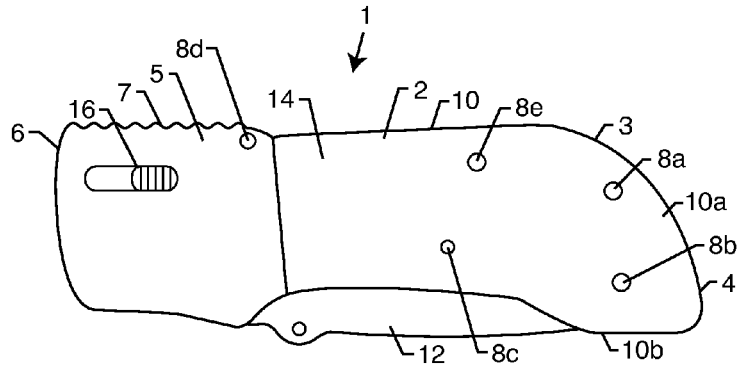
FIGS. 1-3 illustrate an embodiment of a perspective view of a tool, e.g., a knife, of the disclosure in a closed, semi-open, and opened configuration.

Before the present disclosure is further described, it is to be understood that this disclosure is not limited to particular embodiments described, as such may of course vary. It is also to be understood that the terminology used herein is for the purpose of describing particular embodiments only, and is not intended to be limiting. Unless defined otherwise, all technical and scientific terms used herein have the same meaning as commonly understood by one skilled in the art to which this invention belongs.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the disclosure.

Throughout this application, various publications, patents and published patent applications are cited. The disclosures of these publications, patents and published patent applications referenced in this application are hereby incorporated by reference in their entirety into the present disclosure. Citation herein by the Applicant of a publication, patent, or published patent application is not an admission by the Applicant of said publication, patent, or published patent application as prior art.

It must be noted that as used herein and in the appended claims, the singular forms "a", "and", and "the" include plural referents unless the context clearly dictates otherwise. Thus, for example, reference to an "opening" may include a plurality of such openings, and reference to "the gripping element" includes reference to one or more gripping elements and equivalents thereof known to those skilled in the art, and so forth. It is further noted that the claims may be drafted to exclude any optional element. As such, this statement is intended to serve as antecedent basis for use of such exclusive terminology as "solely", "only" and the like, in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

DETAILED DESCRIPTION

Aspects of the disclosure include a tool. In certain instances the tool includes a working portion and a holding portion, wherein the working portion and the holding portion are moveably coupled in such a manner that the working portion may be moved, positioned, and held in place in a plurality of configurations with respect to the holding portion. For instance, in one embodiment, the working portion includes a locking and/or ratcheting mechanism, which locking mechanism may include one or more of an engagement element and/or an engagement element receiver and the blade holder includes one or more of a complementary engagement element receiver and/or engagement element, wherein the engagement element and engagement element receiver are configured for being coupled together in such a manner that the working portion is substantially prevented from moving relative to the holding portion. In certain instances, the working portion and/or holding portion include a ratcheting mechanism, such as a plurality of engagement elements and/or a plurality of corresponding engagement element receivers, e.g., complementary teeth, such that the working portion is capable of being moved incrementally with respect to the holding portion and/or locked in place after each incremental movement. For example, in certain embodiments of a tool of the disclosure, the working portion is a blade, and the holding portion is a blade holder, wherein the blade and the blade holder may be movably coupled together in such a manner that the blade is moveable incrementally with respect to the blade holder and configured for being locked in place after each incremental movement.

Also provided is a method of using a tool of the disclosure as well as a specialized packaging for displaying the tool, e.g., when offering the tool for sale.

The subject tools of the disclosure will be described first, followed by a description of a method of using the tool as well as a description of specialized packaging that may be employed for displaying the tool.

As summarized above, an aspect of the disclosure includes a tool. The tool may be any tool that includes a working portion and a holding portion, wherein the working portion and the holding portion are configured for being coupled together in such a manner that the working portion is capable of moving in relation to the holding portion. As used herein a "working portion" of a tool is that portion of the tool that is configured for interfacing with one or more separate objects so as to manipulate, e.g., exert a force on, the one or more objects. As used herein the "handle portion" of a tool is that portion that is configured for being fit within the grasps of a user and/or manipulated in such a manner so as to operate the working portion of the tool. A tool of the disclosure may be a knife, a wrench, a pliers, a wire-cutters, a hammer, a saw, a ratchet and/or socket, a screw driver, a hole punch, and the like. In certain embodiments, a tool of the disclosure includes a working portion that is moveable in relation to a handle portion and may include a locking mechanism for locking the working portion in relationship to the handle portion and/or a ratcheting portion that allows for the incremental movement of the working portion with respect to the handle portion.

Although it is understood that a tool of the disclosure may be any tool, such as a tool having a working portion and a holding portion, which portions are configured for moving in relation to one another, for purposes of clarity the tool will be exemplified herein as a knife, wherein the working portion is configured as a blade, and the holding portion is configured as a blade holder. Additionally, the "locking mechanism" may be any suitable mechanism that is capable interacting in the coupling of the working portion and the handle portion in moveable relationship with one another in such a manner that when engaged the working portion and the handle portion are prevented from substantially moving in relation to one another. By "substantially," for instance, in the context of "prevented from 'substantially moving'" is meant that although there may be some play between the two portions, extended relative motion will be minimal and/or not to such an extent that is readily detectable.

Further, although it is understood that any suitable locking mechanism may be employed so as to prevent the substantial movement of the working portion relative to the handle portion, for purposes of clarity and in certain embodiments, the locking mechanism will be exemplified herein as including an engagement element and a corresponding engagement element receiver that are configured for being coupled together, such that when coupled together and engaged the locking mechanism prevents the working portion of the tool from substantially moving relative to the handle portion of the tool. Furthermore, although it is understood that a "ratcheting mechanism" may have any of a variety of suitable configurations so as to implement the graduated and/or incremental movement of one or more of the working portion and the handle portion relative to one another, for purpose of clarity and in certain embodiments, the ratcheting mechanism will be exemplified herein as including a plurality of one or both of engagement elements and/or corresponding engagement element receivers that are configured for being coupled together, and moved in relationship to one another such that when coupled together and the working portion is moved in relation to the handle portion the movement is gradual and/or incremental.

Accordingly, in certain embodiments, a tool of the disclosure includes a working portion, e.g., a blade, and a handle portion, e.g., a blade holder, wherein the blade and the blade holder are adapted for being movably coupled to one another and configured for being locked in placed once moved. The blade may have an elongated form which includes a proximal and a distal portion, wherein the proximal portion is configured for being coupled to the blade holder. The blade may also have a front and a back surface and may additionally have a sharpened portion, including a sharpened edge, and a top portion, opposite the sharpened portion, having a blunted edge. The distal portion may be sharpened so as to form a point, curve, or jagged configuration, or may be blunted so as to form a distal edge portion. The sharpened portion and/or sharpened edge of the blade may be elongated and smooth, may be elongated and jagged, or both. The blade may be of any suitable length, of any suitable thickness, and of any suitable height dependent on the task in which it is to be employed. The blade may be straight, curved, jagged, circular, square, elliptical, or the like.

The blade may be formed of any suitable material such as a material capable of being hardened into a rigid form, and in some instance, capable of being sharpened to include an edge. The blade may be formed from a metal, an alloy, a glass, a ceramic, carbon, a plastic, obsidian, or the like. For instance, in certain embodiments, the blade may be formed from a metal or a metal alloy, such as a metal or metal alloy including one or more of bronze, iron, steel, copper, silver, gold, platinum, titanium, aluminum, and the like. The blade may be formed in any manner known in the art including forging, casting, welding, machining, pressing, and the like. A sharpened edge may be added to the blade by any means known in the art, such as by grinding, cutting, e.g., laser cutting, and the like.

In certain embodiments, a tool of the disclosure may include a handle portion, such as a blade holder. For instance, a tool of the disclosure may include a handle portion that is configured for receiving at least a portion of a blade therein or thereon. The handle portion may be comprised of one or more portions, may be solid, save for the blade receiving interface, may be hollowed, or may be made of a plurality of elements that are configured for being coupled together. The blade holder may have an interior lining and/or an exterior grip element. In certain embodiments, the blade holder is configured so as to be movably coupled to a blade. Accordingly, the blade holder may include one or more pieces adapted for allowing the blade to move relative to the blade holder and/or for locking the blade in a position, such as at an angle relative to the blade holder. The blade holder may be of any suitable shape, of any suitable size, and of any suitable configuration. The blade holder may be made out of a metal, metal alloy, plastic, or the like and may be fabricated by any suitable process known in the art.

In certain embodiments, the handle portion includes a proximal and a distal portion with proximal and distal ends, and is configured as a blade holder. In certain embodiments, the blade holder includes a plurality of elements, such as a top portion and a bottom portion wherein the top and bottom portions are configured for being joined either removably or irremovably together so as to from a blade holder housing. It is to be understood that the top and bottom portions may be joined together by any suitable mechanism, however, for the purpose of clarity the top and bottom portions will be set forth herein as being joined together by the use of screws. Accordingly, the top or bottom portions of the blade holder may include one or more of a screw aperture, a screw, and/or a screw receiving portion or screw post that interact together to join a top and a bottom portion of a blade holder together.

In certain instances, the blade holder includes a housing which includes a top and a bottom portion that are configured for being joined together in such a way so as to produce a space or lumen there between. In certain embodiments, the blade holder space or lumen is configured for receiving at least a portion of a blade therein, e.g., between the top and bottom portions of the blade holder. The blade holder space or lumen may also include one or more additional elements, such as one or more elements that are configured for facilitating the movement of the blade relative to the blade holder and/or for locking the blade in place, e.g., in a substantially fixed position relative to the blade holder. The movement of the blade may be linear, which is characterized by lateral movement of the blade within a plane defined by a longitudinal axis of the elongated blade holder; or the movement may be arced or curved or curvilinear such that as the blade moves it traverses an arc with respect to the longitudinal axis defined by the elongated blade holder. For instance, during the movement of the blade a distal portion of the blade may be displaced laterally, in axial movement away from the blade holder along a longitudinal axis defined by the length of the elongated blade holder; or a distal portion of the blade may traverse an arc as a distal portion of the blade is displaced away from the blade holder. The arc traversed may be from about 1° to about 360°, such that at a final stopped position the length of the blade forms an angle with the blade holder which angle may be 5° or less, 10°, 15°, 20°, 30°, 45°, 90°, 120°, 180°, 240°, 300°, up to about a 360° angle or any angle in between.

In certain embodiments, the blade holder may include one or more of a locking mechanism and/or a ratcheting mechanism. In certain embodiments, the locking and ratcheting mechanisms include one or more of the same elements and or may be the same element or groups of elements that are capable of interacting together in such a manner as to perform both a ratcheting and a locking function. For instance, although it is understood that a locking mechanism may be an element distinct from a ratcheting element and may include separate and distinct parts, in certain embodiments, and as disclosed herein, the locking and ratcheting mechanisms may employ one or more of the same parts in achieving its function. Accordingly, in certain embodiments, a locking and/or ratcheting mechanism may include one or more of an engagement element, an engagement element receiver, and/or other elements that interact with at least a portion of the blade or a blade attachment so as to form a locking and/or ratcheting mechanism.

As set forth above, in certain embodiments, the locking and ratcheting mechanisms may be adapted to work in conjunction with one another so as to facilitate the movement of the blade relative to the blade holder, and in certain instances, for locking the blade in a position, such as a position that is angled with respect to the blade holder. The blade may be positioned and held in place in a plurality of configurations with respect to the blade holder, e.g., holding portion. For instance, in one embodiment, the blade includes one or more of an engagement element and/or an engagement element receiver and the blade holder includes one or more of a complementary engagement element receiver and/or engagement element, wherein the engagement element(s) and engagement element receiver(s) are configured for being coupled together in such a manner that the blade is substantially prevented from moving relative to the blade holder. In certain instances, the blade and/or blade holder include a plurality of engagement elements and/or a plurality of corresponding engagement element receivers, e.g., complementary teeth, such that the blade is capable of being moved incrementally or ratcheted with respect to the blade holder.

For instance, one or more of the blade and/or blade holder may include a plurality of engagement elements and/or a plurality of corresponding engagement element receivers that are configured as corresponding teeth. The teeth may be square, circular, curved, or the like. For example, in one embodiment, the teeth include a curved surface and a straight edged surface, such that the complimentary teeth when engaged are capable of moving only in one direction with respect to one another, e.g., in a clockwise or counter clockwise direction, and are prevented from moving in the opposite direction.

In certain embodiments, the blade may include and/or otherwise be associated with a hub, e.g., a blade hub, wherein the blade hub includes one or more of an engagement element and an engagement element receiver. The blade hub may be integral to the blade or may be a portion that is added to or otherwise associated with the blade, e.g., the blade hub may be a blade attachment. In certain instances, the blade hub is a curved, semi-circular, partially circular, substantially circular, circular, or elliptical portion that is associated with a proximal portion of the blade and is adapted for further being associated with the blade holder and/or a locking and/or ratcheting element thereof. The blade hub may be a solid piece or may include an aperture traversing there through from one surface to the other, such as a pivot hole.

In certain embodiments, the blade holder may include one or more of an engagement element and an engagement element receiver. In certain instances, the engagement element and/or engagement element receiver may be configured as a surface, such as a surface of a pawl. The pawl may have any suitable shape and may be any suitable size so long as it includes a surface that includes an engagement element and/or an engagement element receiver that is capable of interacting with a complementary surface on a blade and/or a blade hub so as to modulate the movement of the blade with respect to the blade holder.

For instance, a suitable pawl may include a plurality of surfaces, such as a bottom surface, which surface includes one or more of an engagement element and an engagement element receiver, e.g., teeth; a top surface, which surface may be curved or arced; and a side surface, which surface may be adapted so as to interface with one or more other elements of the locking and/or ratcheting mechanisms. For example, in certain embodiments, the pawl may include a surface that is specially adapted for interfacing with a spring element. Further, in certain embodiments, the pawl may include a top surface that is especially adapted for contacting one or more other elements of the locking and/or ratcheting mechanisms, such as the surface of a pawl pocket, at a special interface, such as a contact patch, wherein the curved surface of the pawl only contacts a surface of the pawl pocket at the area defined by the contact patch.

Furthermore, where a surface of the pawl includes one or plurality of engagement elements and/or engagement element receivers, the engagement elements and/or engagement element receivers may be configured as a tooth or teeth, and in certain embodiments, the tooth or teeth may be configured to engage a corresponding engagement element(s) and/or engagement element receiver(s), e.g., such as engagement elements and/or engagement element receivers positioned on a blade and/or blade hub, so as to prevent movement of the blade and/or blade hub. Dependent on how the tooth or teeth are configured movement may be prevented in either a forward direction, a backward direction, or both. Accordingly, where a tool of the disclosure includes a plurality of pawls, one pawl, e.g., a forward pawl, may be configured for allowing movement in the forward direction but preventing movement in a backward direction, and one pawl, e.g., a backward pawl, may be configured for allowing movement in the backward direction but preventing movement in a forward direction. Hence, in an exemplary embodiment, a system including two pawls may be employed, e.g., in combination with a blade/hub and/or a blade holder, so as to modulate the forward and backward movement of the blade relative to the blade holder.

Accordingly, in certain instances, the blade hub includes a plurality of engagement elements and/or engagement element receivers that are configured as teeth, which teeth correspond to a plurality of engagement elements and/or engagement element receivers on a corresponding pawl, such as a pawl that is configured for interacting with the blade hub so as to modulate the motion of the blade relative to the blade holder. In this exemplary manner, the pawl may interact with the blade and/or blade hub so as to control the movement of the blade relative to the blade holder. For instance, the teeth of the pawl may interact with the teeth of the blade or blade hub such that as the distal portion of the blade is moved away from the blade holder the movement is graduated an/or incremental and in such a manner that the blade may be readily locked into position by the engagement of an associated locking mechanism. Accordingly, the blade may be moved from an encased or contracted position to an exposed, open position that is fully extended or to one or more positions in between and locked therein into place. The movement may be lateral or curved, such that the motion of the blade relative to the blade holder forms an arc, and the blade may be locked in a position that is less or more than fully extended such that an angle is formed between the blade and the blade holder. The blade may of course be locked in the contracted and non-extended position as well as be locked in the opened, fully extended position. In certain embodiments, the blade holder may include a pivot pin, such as a post element that extends from one surface of a top or bottom portion of a blade holder toward the other surface, wherein the pivot pin is configured for extending through an aperture in the blade and/or blade hub, such as a pivot pin hole, thereby forming an axis along which the blade may pivot and/or be rotated, for instance, in an arced movement.

In certain embodiments, the blade holder includes a pawl holder. The pawl holder may be of any suitable shape and of any suitable size so long as the pawl holder is capable of holding the pawl and facilitating the pawl's engagement of the blade and/or blade hub. In certain embodiments, the pawl holder includes one or more pawls, one or more biasing elements, and/or a pocket, such as a pocket into which one or more pawls and/or one or more biasing elements may be positioned. In certain embodiments, the pawl holder may also be configured and/or positioned within the blade holder so as to form one or more blade stops, which blade stops function to abut the blade in an open or closed position and thereby prevent the blade from being over extended in the opened or closed position. In certain embodiments, the blade holder includes one or more blade stops, wherein the blade stops are not integral to the pawl holder, however as noted above, in certain embodiments the blade stop(s) are integral to the pawl holder. Additionally, in certain embodiments, the pawl holder may be integral with the a top and/or bottom portion of a blade holder or a liner surface thereof, and in other embodiments the blade holder is a separate element that is attached to a top and/or bottom portion of a blade holder or a liner surface thereof.

In certain embodiments the pawl holder includes a pawl pocket wherein the pawl pocket includes a curved opening, which curved opening forms or otherwise includes one or more arcs. For instance, the pawl pocket may be configured to include one, two, three, four, five, or more arcs. In certain embodiments, the pawl pocket includes a plurality, e.g., two pawls, which pawls are operatively coupled by at least one biasing element, such as a spring. In certain embodiments, the pawl pocket includes one or more of an arc that is adapted to facilitate the movement of a pawl and/or the movement of a biasing element, and/or the movement of a proximal portion of a blade and/or blade hub. For example, in certain embodiments, the pawl holder includes an arc configured for facilitating the movement of one pawl, and/or an arc that is configured for facilitating the movement of a second pawl, and/or an arc configured for facilitating the movement of a biasing element, e.g., a spring element, and/or an arc configured for facilitating the movement of a portion of the blade and/or blade hub. Accordingly, in certain embodiments, the pawl pocket includes an arc, which arc is symmetrical, e.g., having a consistent degree of curvature, therefore the pawl pocket is symmetrical; and in certain embodiments, the pawl pocket is non-symmetrical, such as when the pawl pocket includes a plurality of arcs, wherein one or more arcs have a different degree of curvature from one or more other arcs.

Accordingly, in certain embodiments, a tool of the disclosure includes both a blade and a blade holder as well as one or more pawls and/or a pawl holder. For instance, the blade and/or blade hub may include one or more, e.g., a plurality, of engagement elements/receivers, e.g., teeth, and the one or more pawls may include one or more, e.g., a plurality, of corresponding engagement elements/receivers, e.g., teeth. The one or more pawls may be positioned within a pocket of a pawl holder, such as a pawl holder that is associated with a top or bottom portion of the blade holder. The pawl pocket may be configured so as to facilitate the movement of the pawl in relation to the blade and/or blade hub so as to modulate and/or lock the movement of the blade with respect to the blade holder. For example, in certain embodiments, the pawl holder includes at least two pawls wherein the pawls are operatively coupled by at least one biasing element, which biasing element exerts a tension on the pawls within the pawl pocket, thereby engaging the pawl with the blade and/or blade hub, thereby preventing the blade from moving relative to the blade holder, and thus locking the blade in position. The biasing element may be controlled in such a manner that it exerts a force on one pawl, both pawls, or on neither pawl. In an exemplary manner such as this, the movement of the blade may be modulated so as to be incremental and/or the blade may be locked into place.

For instance, the biasing element and/or pawls may be manipulated in such a manner that one or more pawls are displaced with in the pawl pocket wherein an engagement element/receiver of the pawl is disengaged from a corresponding engagement element/receiver of the blade and/or blade hub. Accordingly, movement of the blade and/or blade hub will be regulated by the pawl that is still engaged. Therefore, dependent on the design of the engagement elements of the pawl, one of forward or backward movement may be allowed and movement in the opposite direction will be prevented. Accordingly, a pawl that allows movement in the forward direction but prevents movement in the backward direction may be termed a forward pawl; and a pawl that allows movement in the backward direction but prevents movement in the forward direction may be termed a backward pawl.

Accordingly, where two pawls are included within the pocket of a pawl holder, e.g., a forward pawl and a backward pawl, disengagement of the backward pawl will allow movement of the blade in the forward direction away from the blade holder; and disengagement of the forward pawl will allow movement of the blade in the backward direction toward the blade holder. Of course, disengagement of the both pawls will allow free movement of the blade relative to the blade holder in the forward and backward directions, and engagement of both pawls will prevent movement in either the forward ad backward direction, thereby locking the tool. It is to be noted, although the above has been described with reference to two pawls, such as a pawl that regulates movement of the blade in a forward direction, e.g., a forward pawl, and that regulates movement of the blade in a backward direction, e.g., a backward pawl, and one biasing element, more or less pawls and/or more or less biasing elements may be included, as indicated above, with the appropriate modifications to the system as a whole.

As noted above, in certain embodiments, the blade holder includes a biasing element. The biasing element may be a component in a biasing mechanism. The biasing mechanism, where included, may include one or more of a biasing element, a selector plate, and a selector switch. The selector plate may include one or more of a pawl aperture, a pivot aperture, a body, and a selector plate tab. In certain embodiments, the biasing mechanism is configured for interacting with the one or more engagement elements, e.g., pawls, so as to modulate the engagement of the pawl with its corresponding engagement element receiver, e.g., a tooth or teeth of the blade and/or blade hub. For instance, the biasing mechanism may be moveable, e.g., laterally, forward toward a distal portion of the blade holder, or backward toward a proximal potion of the blade holder.

As indicated above, the biasing mechanism may include a selector plate that has a body that defines a plurality of apertures. One of the apertures may comprise a pawl aperture and may have walls and/or surfaces that are configured for engaging one or more pawls, such as a plurality of pawls, in such a manner that as the selector plate is moved the engagement of the pawl with the blade and/or blade hub is modulated. For example, the blade holder may include at least two pawls, which pawls are separated one from the other by a biasing element, such as a spring, which spring operatively couples the two pawls together. The selector plate may be moveable from a neutral position to a forward or backward position. In certain embodiments, when the selector plate is in the neutral position, both pawls are engaged with the blade and/or blade hub, and the blade is locked into position, e.g., a closed, partially opened, or fully opened position. In certain embodiments, when the selector plate is moved e.g., from a neutral position, to a forward position, one pawl, e.g., a forward regulating pawl, is moveably engaged by a respective surface of the selector plate body defining the pawl aperture within which the pawl is positioned and thereby the pawl is moved from an engaged position to a non-engaged position and the blade is therefore capable of moving in one direction relative to the blade holder, e.g., from a closed to an open position. In certain embodiments, when the selector plate is moved, e.g., from a neutral, to a backward position the other pawl, e.g., a backward regulating pawl, is moved from an engaged position to a non-engaged position and the blade is therefore capable of moving in another direction relative to the blade holder, e.g., from an open to a closed position. In an exemplary manner such as this a tool of the disclosure may include a blade that may be locked with respect to a blade holder in a variety of different configurations wherein the angle formed by the blade with respect to the blade holder may vary. In certain embodiments, for instance, where the blade holder includes a pivot pin, the selector plate may additionally include a pivot aperture through which the pivot pin extends. The aperture may additionally be sized or otherwise configured for being associated with a washer or other bushing which washer or bushing may be configured for being associated with one or more of the pivot pin and/or the selector plate.

In certain embodiments the selector plate, where included, may include a selector tab. The selector tab may have any suitable configuration so long as it is configured for associating with one or more elements of the blade holder in a manner sufficient to allow a movement of the selector plate to be selected. For instance, the selector tab my simply be a protrusion extending from the body of the selector plate. Accordingly, in certain embodiments, the blade holder may include a selector button or switch, such as a thumb switch, which thumb switch is operable by a user of the tool and configured for effecting the movement of the selector plate. A thumb switch may include an extended body, which body includes one or more of a switch button, a selector tab engagement element, e.g., a switch tab, and/or one or more detent holes or detents. For example, in certain embodiments, the thumb switch includes a switch button, which switch button servers as a user interface for selecting an open, closed, and/or locked position of the blade.

Accordingly, the thumb switch may have a forward, e.g., open position, a neutral, e.g., locked position, and a backward, e.g., closed position, such that when in the open position, the blade may be readily opened, when in the closed position, the blade may be readily closed, and a locked position, wherein when in the locked position the blade is prevented from substantial movement in the open or closed direction. Thus, if the thumb switch is in the locked position and the blade is received within the blade holder, then the blade is prevented from being opened, and if the blade is extended or otherwise in an open or exposed configuration, and the thumb switch is in the locked position, the blade will be prevented from further opening or closing.

Hence, in certain embodiments, the thumb switch includes an elongated body having a top surface and a bottom surface and the top or bottom surface thereof may be configured for engaging the selector plate and thereby effecting the movement of the selector plate as the thumb switch is moved. For instance, in one exemplary embodiment, a bottom surface of the thumb switch may include one or more selector plate engagement elements, which engagement elements are configured for associating with a portion of the selector plate. The selector plate engagement elements may be configured as a groove, tab, or the like. For example, in one embodiment, the selector plate engagement element includes a plurality of tabs spaced apart from one another so as to be adapted to receive a selector plate tab there between, and in such an exemplary configuration the selector tab may be moved, e.g., laterally, thereby effecting the movement of the selector plate, and in turn effecting the movement of a biasing mechanism, e.g., one or more engagement elements, e.g., pawls, associated therewith, e.g., contained within the pawl aperture and engaged by the selector plate body.

The thumb switch body may additionally include one or more ball detent holes either on a top or bottom surface thereof, the purpose of which is described in greater detail herein below. However, briefly, in certain embodiments, a top or bottom portion of a blade holder and/or a blade holder liner may include a spring portion, e.g., a biased cut out portion, which spring portion includes a ball detent, which ball detent is configured for at least being partially fit within a ball detent hole. So as to facilitate the movement of the thumb switch along a forward and/or backward direction and to reduce play in the overall system. In certain embodiments, the ball detent hole and the ball detent are configured so as to be slightly misaligned in such a manner that although the ball detent partially enters the ball detent hole it is not completely fitted within the ball detent hole.

Other features and advantages of the presently described tools will become apparent from the following more detailed descriptions provided in conjunction with specific exemplary embodiments of a tool of the disclosure. Accordingly, the following disclosure is provided in conjunction with the accompanying drawings so as to illustrate, by way of example only, the principles of the presently described tools. Therefore, the description set forth below and the accompanying figures are meant as exemplary embodiments of a tool of the disclosure and are not meant to be limiting to the precise embodiments provided.

Figure 8:
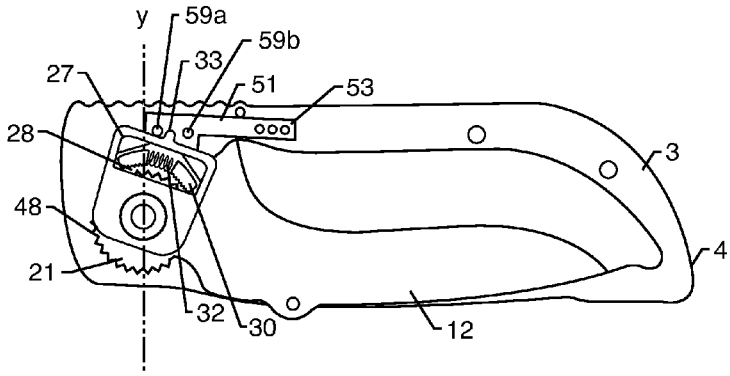
FIGS. 8-10 show the knife of FIG. 1 in a closed, semi-open, and opened configuration with a top portion of the blade holder removed.
Figure 9:
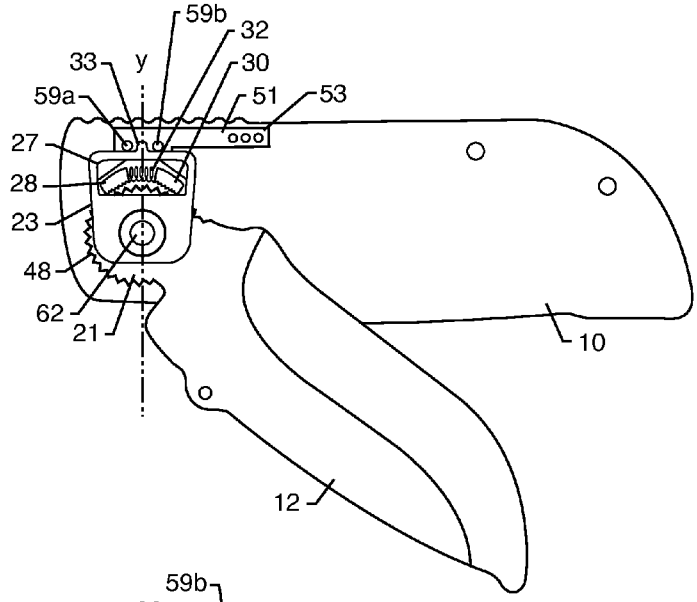
Figure 10:
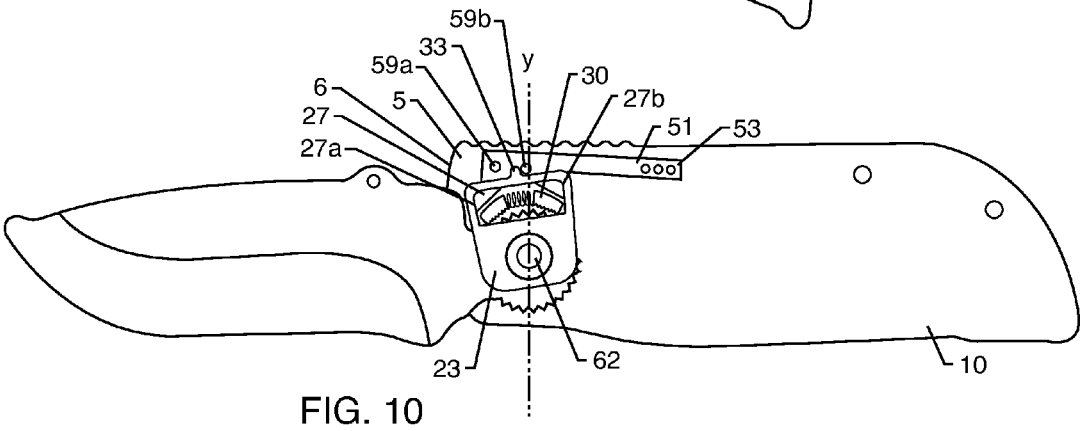

Specifically, various embodiments of the subject tools of the disclosure will now be described with reference to the figures. For clarity and convenience, the tool and/or tool assembly is exemplified in the figures and below as a knife including a blade and a blade holder, e.g., a knife handle. However, as described above, other embodiments of a tool are contemplated by the disclosure. FIG. 1 shows a perspective view of a tool, e.g., a knife, of the disclosure in a closed, semi-open, and opened configuration. FIGS. 4-7 show the knife of FIG. 1, with a top portion of the blade holder removed, for clarity purposes. FIGS. 8-10 show the knife of FIG. 1 in a closed, semi-open, and opened configuration with a top portion of the blade holder removed.

Figure 2:
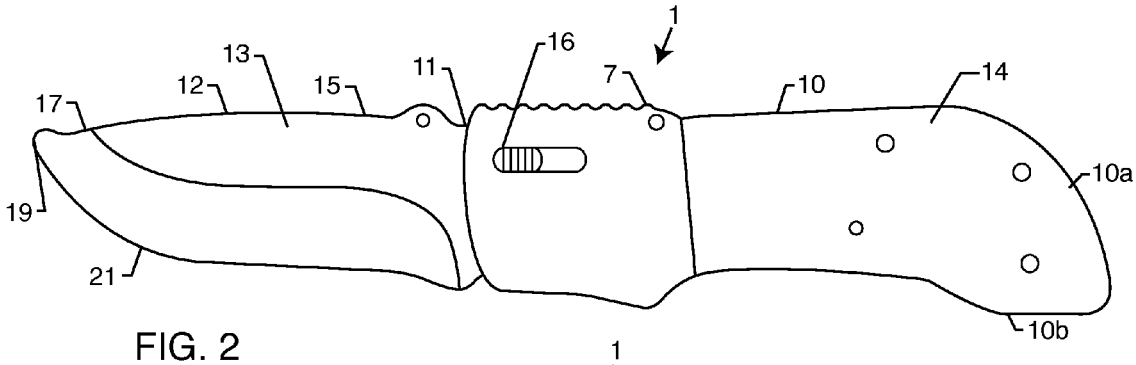
Figure 3:
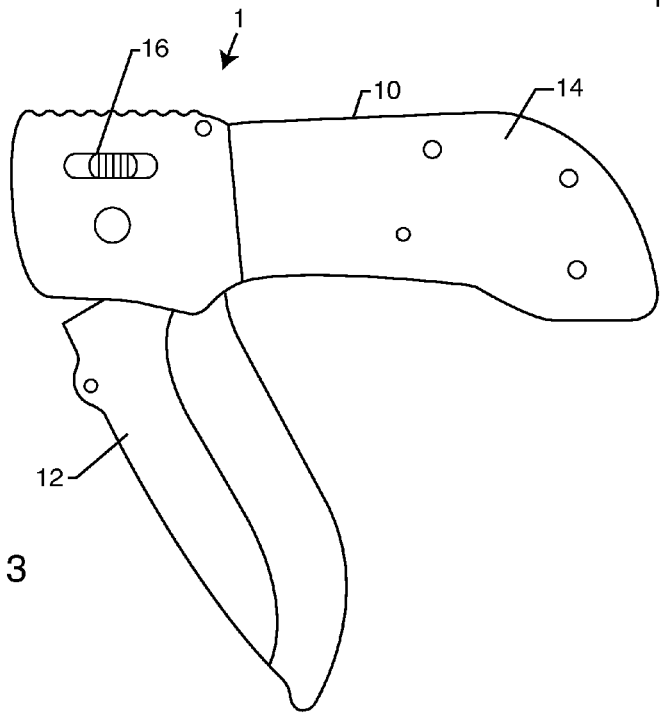

FIG. 1 illustrates a tool of the disclosure in a closed configuration, wherein the thumb switch button is in a backward, or closed position, and the blade is retracted and at least partially received within a housing of the blade holder. As can be seen with reference to FIG. 1, in certain embodiments, a tool 1 of the subject disclosure includes a handle portion, configured as a blade holder 10, where in the blade holder 10 includes an elongated body 2 including a proximal portion 3 having a proximal end 4, and including a distal portion 5 having a distal end 6. The blade holder 10 includes a top portion 10*a* and a bottom portion 10*b*, which portions when coupled together form a housing 14. The tool additionally includes a working portion, configured as a blade 12. As seen with reference to FIG. 2, the blade includes an elongated body 13 including a proximal portion 15 having a proximal end 11, and including a distal portion 17 having a distal end 19. As depicted the distal end 19 includes a sharpened tip. The blade 12 additionally includes a sharpened edge portion 21. The tool further includes a thumb switch button 16 as well as gripping element 7 and screw hole apertures 8*a-e*. FIG. 2 illustrates the tool of FIG. 1, wherein the thumb switch button 16 is in a forward, or open position, and the blade 12 is in a fully extended, open position. FIG. 3 illustrates the blade of FIG. 1, wherein the thumb switch button 16 is in a neutral or locked position, and the blade 12 is in a partially extended, partially open and locked position. In the locked position, the blade 12 is substantially prevented from moving relative to the blade holder 10, and thus may neither be opened nor closed further, but rather is locked into position.

Figure 4:
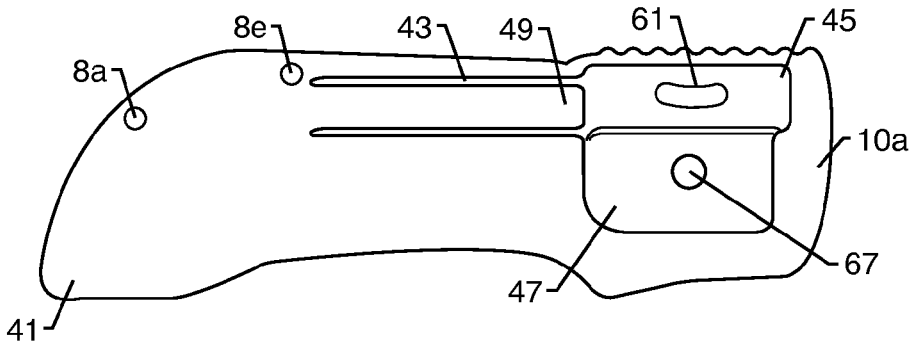
FIGS. 4-7 illustrate an embodiment that shows the knife of FIG. 1, with a top portion of the blade holder removed, for clarity purposes.

FIG. 4 illustrates the tool of FIG. 1, wherein the blade is in a closed position; however, the top portion 10*a* has been removed, see FIG. 4, so as to reveal the various components included within the housing 14 of the tool 1. As can be seen with respect to FIG. 4, a top portion 10*a* of the housing 14 of the blade holder 10, includes a top surface (not shown) and a bottom or inside surface (depicted). The bottom surface includes a top surface liner. The top surface liner 41*a* includes a liner spring 43, a thumb-switch cavity 45, and a selector plate cavity 47. The liner spring 43 includes a ball detent 49. The thumb-switch cavity 45 is configured for receiving a thumb-switch plate, see 53 of FIG. 6, and includes a thumb switch button orifice 61, which orifice is configured for allowing a thumb switch button, see 55 of FIG. 6, to pass there through. The selector plate cavity 47 is configured for receiving a selector plate, 23 of FIG. 5, therein and may additionally include a pivot pin or screw aperture 67.

Figure 6:
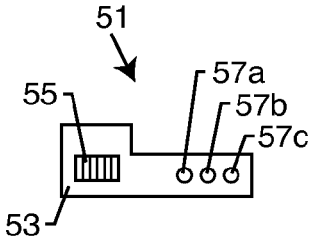
Figure 7:
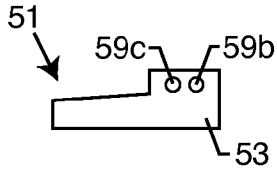

FIGS. 6 and 7 illustrate a front and a bottom surface of an embodiment of a thumb-switch 51 of the disclosure. The thumb-switch 51 includes an elongated plate body 53 that is configured for being positioned within the thumb-switch cavity 45. The thumb-switch 51 is adapted so as to be able to move within the thumb-switch cavity 45 forward and backward from a neutral to a forward or backward position and vice versa. The thumb-switch 51 includes a thumb-switch plate body 53 which includes a proximal and a distal portion. As illustrated in FIG. 6, the thumb-switch plate body 53 includes a top surface, wherein a distal portion of the top surface includes a thumb-switch button 55. The thumb-switch button 55 is raised with respect to the top surface of the thumb-switch plate body 53 and is configured for at least partially passing through a thumb-switch orifice 61 of the top portion 10*b* of a blade holder 10, and is adapted for being engaged by a user so as to manipulate the thumb-switch 51. The thumb-switch plate body 53 additionally includes a plurality of ball detent holes 57 *a, b*, and *c*, passing through the top surface to the bottom surface of the thumb-switch plate body 53. The ball detent holes 57*a-c* are positioned on a proximal portion of the elongated thumb-switch plate body 53, which proximal portion is configured for being associated, e.g., fitted under, the liner spring element 43 in such a manner that the ball detent 49 may be associated with ball detent holes 57*a*, 57*b*, and/or 57*c* as the thumb-switch 51 is moved.

For example, in a neutral position, the thumb-switch button 55 is positioned relatively in the middle of the thumb-switch orifice 61, as exemplified in FIG. 2. In this position, the blade 12 is in a locked position, where in such position the blade 12 is prevented from moving relative to the blade holder 10. Additionally, in this position, the ball detent 49 is positioned so as to at least partially align with the ball detent hole 57*b*. As the thumb-switch 51 is engaged and moved from the neutral position to the forward position, the thumb-switch plate body 53 moves toward the distal portion 5 of the blade holder 10 (see FIG. 2), and as the thumb-switch plate body 53 moves forward, away from the liner spring element 43, the ball detent 49 disengages ball detent hole 57*b* and becomes at least partially aligned with ball detent hole 57*c*. In this position, the blade 12 is unlocked with respect to the forward direction, and thus at least a portion of the blade 12 may move away from the blade holder 10 and therefore the knife may be opened. As described in greater detail below, in this position the blade 12 remains locked with respect to the backward direction, e.g., the knife cannot be closed, but the blade may continue to be opened, e.g., incrementally, with respect to the forward direction, until either blade 12 is fully extended or until the thumb-switch 51 is moved once again into the neutral, e.g., locked, position, as exemplified in FIG. 3, thereby locking the blade into position.

However, as the thumb-switch 51 is engaged and moved from the neutral position to the backward position, the thumb-switch plate body 53 moves toward the proximal portion 3 of the blade holder 10, as exemplified in FIG. 2, and as the thumb-switch plate body 53 moves backward, toward the liner spring element 49, the ball detent 49 disengages ball detent hole 57*b* and becomes at least partially aligned with ball detent hole 57*a*. In this position, the blade 12 is unlocked with respect to the backward direction, and thus at least a portion of the blade 12 may move toward the blade holder 10 and therefore the knife may be closed. As described in greater detail below, in this position the blade 12 remains locked with respect to the forward direction, e.g., the knife cannot be opened, but the blade may continue to be closed, e.g., incrementally, with respect to the backward direction, until either blade 12 is encased within the housing or until the thumb-switch 51 is moved once again into the neutral, e.g., locked, position, as exemplified in FIG. 3, thereby locking the blade into position. Accordingly, in certain embodiments, the ball detent 49 and ball detent holes 57*a-c* interact with one another so as to secure the thumb-switch 51 within the thumb switch cavity 45 and in association with the liner spring element 43 reduce play within the overall switch system.

As illustrated in FIG. 7, the thumb-switch 51 includes a thumb switch plate 53, which thumb-switch plate 53 includes a bottom surface, wherein a distal portion of the bottom surface of the thumb-switch plate 53 includes at least one selector plate engagement element 59. As depicted, the selector plate engagement element is exemplified by a plurality of posts or switch tabs 59*a* and 59*b*, which extend away from the bottom surface. As described in more detail herein below with reference to FIGS. 8-10, the switch tabs 59*a* and *b* are configured for engaging a portion of the selector plate 23, e.g., a selector plate tab 33 of FIG. 5, in such a manner that as the thumb-switch 51 is moved the associated selector plate 33 is moved.

Figure 5:
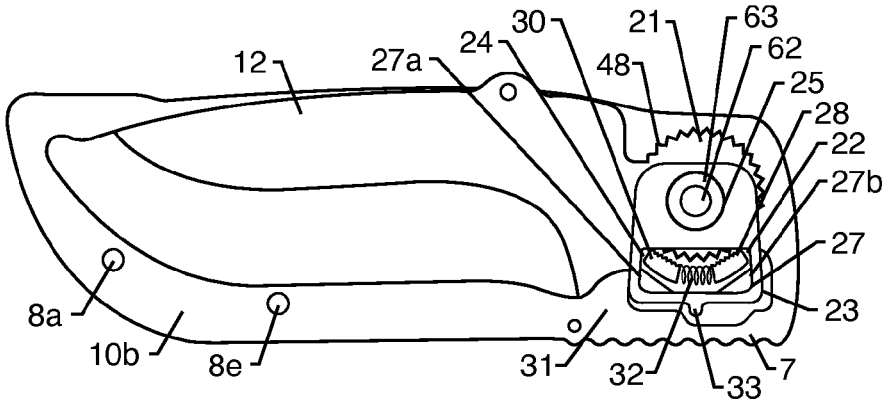

As can be seen with respect to FIG. 5, the tool includes a blade holder bottom portion 10*b*, which blade holder bottom portion 10*b* is associated with a blade 12, which blade 12 is in a contracted configuration and received within the blade holder portion 10*b*. The blade 12 includes a blade hub 21, which blade hub 21 includes an engagement element receiver portion configured as teeth 48. A selector plate 23 and a pawl holder 31 are also included.

The selector plate 23 includes a pivot aperture 25 and a pawl aperture 27. The pivot aperture 25 is configured for receiving a pivot pin 62 of the blade holder 10*b*, and is configured for additionally receiving or otherwise associating with a bushing 63. The pawl aperture 27 is bounded by a body that includes surfaces 27*a* and 27*b* that configured for engaging a pair of respective pawls 28 and 30.

The pawl holder 31 includes a pocket or chamber 22 within which chamber are positioned a pair of pawls 28 and 30 as well as a biasing element, configured as a spring 32. The spring 32 is configured for operatively coupling the pawls 28 and 30 with one another. The pawl pocket 22 includes an arc that forms a surface that is composed of wall portions 24 and 26, which wall portions at least partially bound the pawl pocket 22 and which wall portions may engage portions, e.g., engagement patches, of respective pawls 28 and 30, when said pawls are engaged.

Specifically, when both of the pawls are engaged, as illustrated in FIG. 5, the selector plate 23 is in a neutral position, wherein the pawls 28 and 30 are in contact with both the teeth 48 of the blade hub 21 and with respective wall portions 24 and 26 of the pawl pocket 22. For example, the teeth of the pawls 28*a* and 30*a*, respectively, are coupled to and engaged with the teeth 48 of the blade hub 21. In this configuration, although the walls 27*a* and 27*b* of the pawl aperture 27 of the selector plate 23 may be in contact with one or both of the pawls 28 and 30, neither of the pawls are forcibly engaged by the walls 27*a, b* of the pawl aperture 27. Thus, the blade 12 is in a locked position and may not be opened. FIGS. 8-10 illustrate the interaction of the selector plate 23 with the pawls 28 and 30, when the knife is in the closed, opened, and partially opened configurations.

For example, when the thumb-switch 51 is in a neutral or locked position, the thumb-switch button 55 is positioned relatively in the middle of the thumb-switch orifice 61 (as depicted above) and the selector plate 23 is positioned in a neutral position. See FIG. 9. In this neutral position, the selector plate tab 33 is associated with the selector plate engagement element 59, e.g., tab 33 is fit in between the switch tabs 59*a* and 59*b*, but the selector plate engagement element 59 is not otherwise forcibly engaged with the selector plate tab 33. Specifically, in the neutral position, the selector plate engagement element 59 is associated with the selector plate tab 33 but is not exerting a moving force on the selector plate tab 33. See, for instance, FIG. 9.

As illustrated in FIG. 9, when the thumb-switch 51 is in the neutral position, the selector plate tab is positioned between switch tabs 59*a* and 59*b* and the selector tab 33 aligns with a central axis y that cuts through the middle of switch tabs 59 *a, b* and pivot pin 62. As indicated above, when in the neutral position, the walls 27*a* and 27*b* of the pawl aperture 27 are associated with the pawls 28 and 30, but do not exert a moving force thereon. However, the biasing element, e.g., spring element, 32 is in an expanded configuration and thereby exerts a force on each of pawls 28 and 30. Accordingly, in this neutral configuration, a portion of the pawls 28, 30 are being pressed against the walls of the pawl pocket 24 and 26, as well as against the walls 27*a, b* of the pawl aperture 27, and the teeth of the pawls 28, 30 are aligned with and exerting a force against the corresponding teeth 48 of the blade hub 21. Thus, because of the force being exerted on pawls 28, 30 by the spring element 32, the teeth of the pawls align with the teeth of the blade hub 21 thereby locking the blade 12 in place and preventing the movement of the blade 12 relative to the blade holder 10.

However, as the thumb-switch 51 is engaged and moved from the neutral position to the forward position, the thumb-switch plate body 53 moves toward the distal portion 5 of the blade holder 10 (see FIG. 2), and as the thumb-switch plate 53 moves forward, switch tab 59*b* engages and exerts a moving force on the selector plate tab 33, causing the whole selector plate 23 to move, e.g., rotate around pivot pin 62, in a forward direction. The selector plate tab 33 therefore moves away from axis y toward the distal end 6 of the blade holder 10. See for instance, FIG. 10. As indicated above, when in the biased open position, the wall 27*b* of pawl aperture 27 is both associated with the pawl 30 and exerts a force thereon, which force displaces pawl 30 into the pawl pocket 22 causing the spring element 32 to contract thereby disengaging the teeth of pawl 30 from interfacing with the teeth 48 of blade hub 21 and allowing the blade to rotate about pivot post 62 from a more closed, contracted configuration to a more open, extended configuration. Additionally, the displacement of pawl 30 into pawl pocket 22 causes the contraction of the spring element 32 and the exertion of increased force onto pawl 28, thereby forcing pawl 28 into tighter contact with wall 27*a* of pawl aperture 27 and forcing the teeth of pawl 28 into greater contact with teeth 48 of blade hub 21, which results in an increased resistance to the movement of the blade in a backward direction which in turn further prevents the blade from being closed.

Accordingly, in this position, the blade 12 is unlocked with respect to the forward direction, and thus at least a portion of the blade 12 may move away from the blade holder 10 and therefore the knife may be opened. However, as described above, in this position the blade 12 remains locked with respect to the backward direction, e.g., the knife cannot be closed, but the blade may continue to be opened, e.g., incrementally, with respect to the forward direction, until either blade 12 is fully extended or until the thumb-switch 51 is moved once again into the neutral, e.g., locked, position (see FIG. 3) thereby locking the blade into position.

As illustrated in FIG. 8, as the thumb-switch 51 is engaged and moved from the neutral position to the backward position, the thumb-switch plate body 53 moves toward the proximal portion 3 of the blade holder 10 (see FIG. 1), and as the thumb-switch plate body 53 moves backward, switch tab 59*a* engages and exerts a moving force on the selector plate tab 33, causing the whole selector plate 23 to move, e.g., rotate, in a backward direction, e.g., the selector plate tab 33 therefore moves away from the axis y toward the proximal end 4 of the blade holder 10. See for instance, FIG. 8. As indicated above, when in the biased closed position, the wall 27*a* of pawl aperture 27 is both associated with the pawl 28 and exerts a force thereon, which force displaces pawl 28 into the pawl pocket 22 causing the spring element 32 to contract thereby disengaging the teeth of pawl 28 from interfacing with the teeth 48 of blade hub 21 and allowing the blade to rotate about pivot post 62 from a more open, extended configuration to a more closed, contracted configuration. Additionally, the displacement of pawl 28 into pawl pocket 22 causes the contraction of the spring element 32 and the exertion of increased force onto pawl 30, thereby forcing pawl 30 into tighter contact with wall 27*b* of pawl aperture 27 and forcing the teeth of pawl 30 into greater contact with teeth 48 of blade hub 21, which results in an increased resistance to the movement of the blade in a forward direction which in turn further prevents the blade from being opened.

Accordingly, in this position, the blade 12 is unlocked with respect to the backward direction, and thus at least a portion of the blade 12 may move toward the blade holder 10 and therefore the knife may be closed. However, in this position the blade 12 remains locked with respect to the forward direction, e.g., the knife cannot be opened, but the blade may continue to be closed, e.g., incrementally, with respect to the backward direction, until either blade 12 is received within the housing 14 or until the thumb-switch 51 is moved once again into the neutral, e.g., locked, position (see FIG. 3) thereby locking the blade into position.

Figure 11:
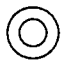
FIGS. 11-16 show another embodiment of components of a knife of the disclosure.
Figure 12:
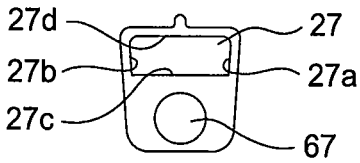
Figure 13:
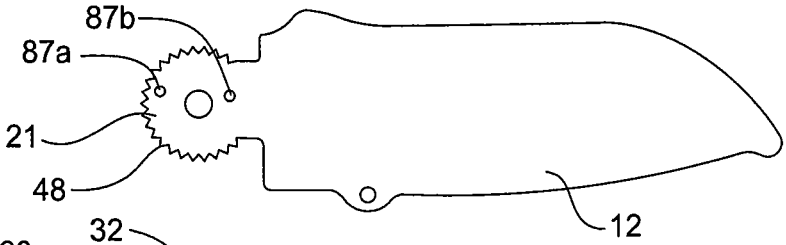
Figure 14:
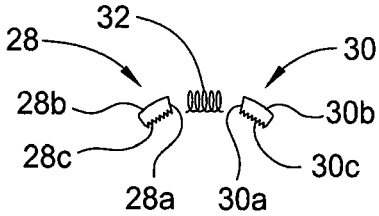
Figure 15:
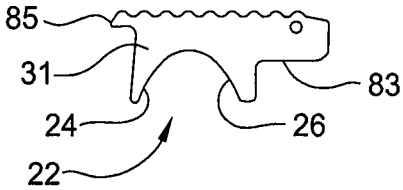
Figure 16:
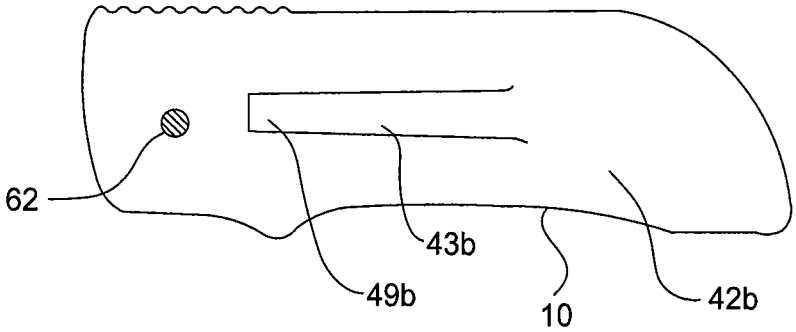

FIGS. 11-16 illustrate a piece by piece view of various components of an exemplary tool 1 of the disclosure. As seen with reference to FIG. 16, the tool 1 may include a blade holder 10*b*, which blade holder 10*b* may include a blade holder liner 41*b* and a pivot post 62. The blade holder liner 41*b* may include a liner spring element 43*b*, which liner spring element 43*b* may include a ball detent. As can be seen with reference to FIG. 15, the tool 1 may include a pawl holder 31, which pawl holder 31 may include a pawl pocket 22, wherein the pawl pocket 22 may include one or more arcs. The pawl pocket 22 may include walls 24 and 26 and the surface between walls 24 and 26 may be curved so as to define a curved, e.g., circular or elliptical, space there between. As described above, the pawl pocket 22 may be configured so as to receive one or more of a pawl, e.g., a plurality of pawls, and/or a biasing element, e.g., a spring, there within. As illustrated, the pawl holder 31 may additionally include one or more, e.g., a plurality, of configurations, e.g., 83 and 85, that are adapted to act as blade stops, which function to prevent the blade from being over extended in the closed and opened configurations, respectively. As can be seen with reference to FIG. 14, the tool 1 may include a plurality of pawls 28 and 30 and a biasing element 32. As depicted, the pawls may include a plurality of surfaces one or more of which has a different configuration from the others. For instance, the pawl 28 or 30 may include a first surface that is linear and flat such as surface 28*a* or 30*a*, which surface may be configured for engaging a biasing element 32. The pawl 28 or 30 may include a curved surface 28*b* or 30*b*, which surface is configured for engaging a wall 24 or 26 of the pawl pocket 22, for instance, at a specific contact location. The pawl 28 or 30 may include a surface 28*c* or 30*c*, wherein the surface has been modified so as to include one or more engagement elements/receivers, such as a tooth or teeth, which surface is configured for engaging one or more complementary engagement elements/receivers, e.g., teeth, of a corresponding portion of a blade or blade hub, to thereby form a ratcheting and/or locking mechanism therewith. As can be seen with reference to FIG. 13, the tool 1 may include a blade 12 which blade may include or be attached to a blade hub 21. The blade/blade hub may include a pivot aperture through which a pivot post may be inserted. In such an exemplary manner, the blade 12 may be configured for rotating around a pivot post. The blade/blade hub may include one or more ball detent holes, such as 87*a* and 87*b*, which holes may be configured for at least being partially aligned with a ball detent, e.g., a ball detent such as ball detent of blade holder 10*b*, wherein when associated with the ball detent play within the system is reduced thereby. The blade/blade hub may include one or more, e.g., a plurality, of engagement elements/receivers that may be configured as teeth 48, which teeth 48 may be complementary to one or more teeth of a pawl, e.g., 28 or 30. As can be seen with reference to FIG. 12, the tool 1 may include a selector plate 23. The selector plate may include a pivot post aperture 67 and/or may include a pawl aperture 27. The pawl aperture may be bounded by a plurality of surfaces such as by surfaces 27 *a, b, c*, and *d*. The selector plate 23 may include a tab portion 33. The pivot post aperture 67 may be configured for being associated with a bushing, such as a bushing 89, as illustrated in FIG. 11. One or more other washers may additionally be included within tool 1.

In another exemplary embodiment of a tool, for instance, a knife, of the disclosure, the present disclosure provides for a knife that includes a ratcheting mechanism, accordingly, the knife may be termed a ratcheting knife. In certain embodiments, the ratcheting knife may include an external thumb switch or slider a portion of which is mechanically engageable with a pair of pawls, which pawls are disposed within a pocket in a handle of the knife. A pair of spring elements may be included, wherein the spring elements bias the pawls, depending upon the positioning of the slider, against an interengageable portion of the knife blade.

For instance, in a first position, the slider engages the first pawl, such that the first pawl is disengaged from the knife blade and the second pawl is engaged with the knife blade. Accordingly, the knife blade may ratchet in one direction against the second pawl, from an extended position toward the stored position. However, the ratcheting mechanism prevents the knife blade from rotating in the opposite direction.

Likewise, when the slider is in a second position and engaged with the second pawl, the second pawl is disengaged from the knife handle while the first pawl is engaged to the knife handle. Accordingly, the ratcheting mechanism permits the knife handle to rotate from the stored position to an extended position. The ratcheting mechanism prevents the knife blade from rotating in the opposite direction.

Alternatively, the slider may be positioned intermediate the first and second positions to lock the knife blade from rotating in either direction. In this case, the knife blade may be locked at any one of a number of a plurality of angled positions relative to the knife blade handle.

Figure 17:
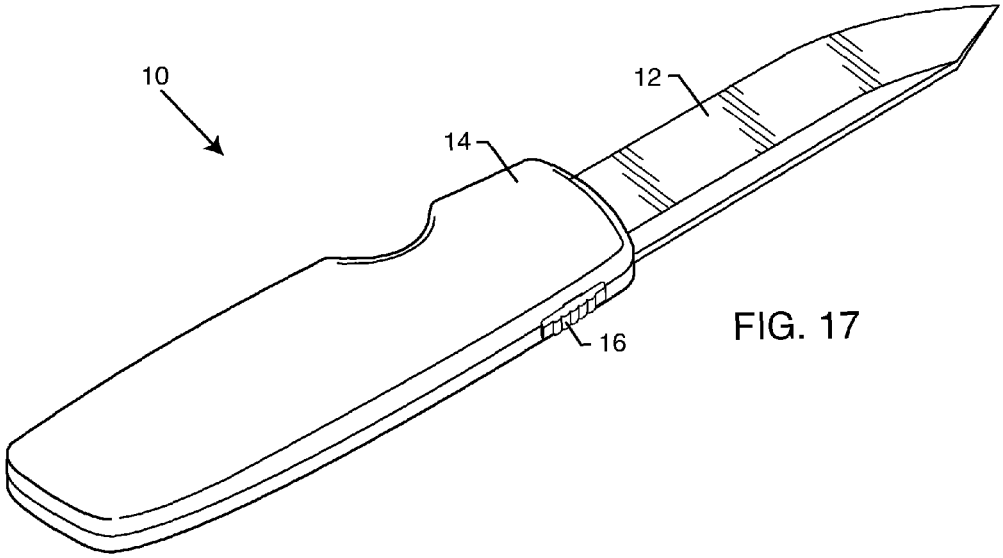
FIG. 17 is a perspective view of a knife handle incorporating a ratcheting mechanism in accordance with an embodiment of the present disclosure.

As shown in the following figures, which are presented herein for purposes of illustration, the present disclosure for a ratcheting knife is generally referenced by the number 10. As shown in FIG. 17, the ratcheting knife 10 has a knife blade 12 pivotally mounted to a handle housing 14 with an activation slider 16 external thereof. The activation slider 16 includes a plurality of ridges or bumps 18 to enhance the traction when sliding the activation slider 16 via the fingertip. The knife blade 12 may rotate from a fully extended position (FIG. 19) to a fully stored position (FIG. 23) or be locked anywhere there between (e.g. FIG. 25) in accordance with the ratcheting mechanism of the present invention.

Figure 18:
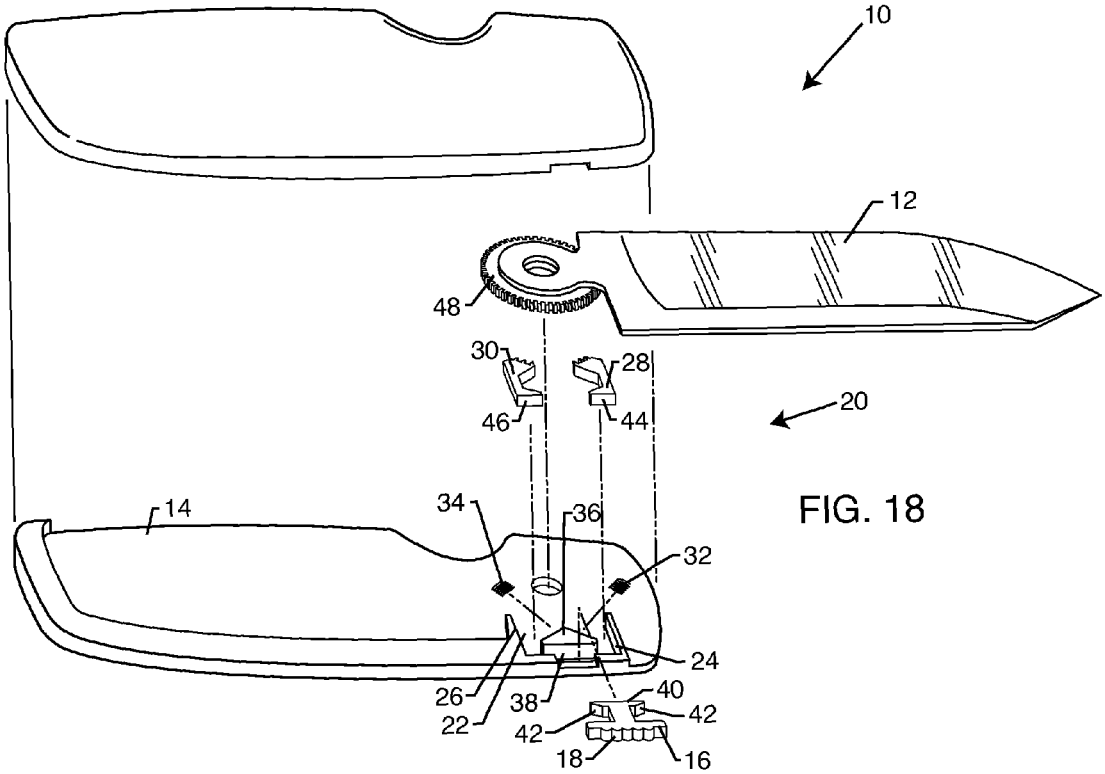
FIG. 18 is an exploded perspective view of a ratcheting mechanism.

FIG. 18 illustrates a ratcheting mechanism 20 in accordance with an embodiment of the present disclosure. The ratcheting mechanism 20 resides within a chamber 22 formed in one section of the handle housing 14. The chamber 22 includes a pair of sidewalls 24, 26 for preventing horizontal movement of an extending pawl 28 and a retracting pawl 30. The pawls 28, 30 are biased up against the walls 24, 26 by a first spring 32 and a second spring 34 connected to a base 36 of the handle housing 14. Accordingly, a top portion 38 of the base 36 allows sliding movement of a bottom portion 40 of the activation sliders 16. The bottom portion 40 includes a pair of angled feet 42 that fit into a pair of angled receptors 44, 46 in the extending pawl 28 and the retracting pawl 30, respectively. As described more fully below, the side-to-side movement of the activation slider 16 within the chamber 22 determines the positioning of the pawls 28, 30 therein for engagement or disengagement from a gear 48 formed as part of the knife blade 12.

Figure 19:
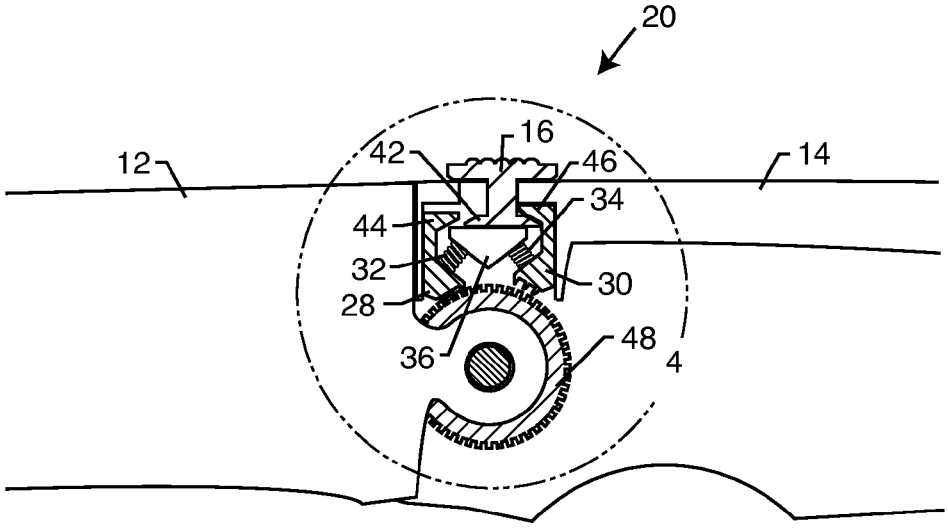
FIG. 19 is a side view of a ratcheting mechanism engaged to and maintaining a knife blade in a fully extended position.

FIG. 19 illustrates the ratcheting mechanism 20 integrated into the handle housing 14 and the knife blade 12, in accordance with an embodiment of the present disclosure. As shown, the activation slider 16 is engaged with the retracting pawl 30. Engagement of the retracting pawl 30 causes compression of the second spring 34 into the base 36. Accordingly, the angled feet 42 are no longer engaged with the angled receptor 44 of the extending pawl 28. Thus, the extending pawl 28 is biased downwardly by the first spring 32 for engagement with the gear 48.

Figure 20:
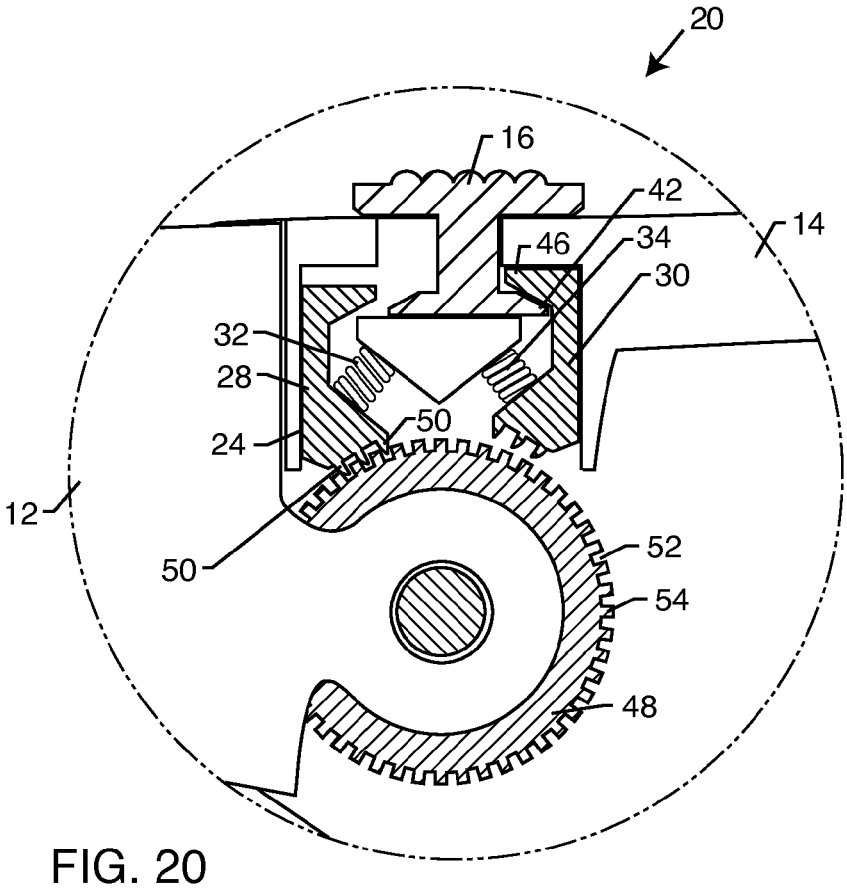
FIG. 20 is an enlarged side view of the ratcheting mechanism taken about the circle 4 in FIG. 19.

The enlarged view of FIG. 20 illustrates engagement of a set of extending teeth 50 with a plurality of notches 52 formed as part of the gear 48. The extending teeth 50 stay engaged with the gear 40 via the notches 52 and a set of corresponding gear teeth 54. Accordingly, the extending pawl 28 prevents movement of the knife blade 12 from the extended position to the retracted position. Any attempted counter-clockwise rotation of the knife blade 12 from the extended position (as shown) to a retracted position would be prevented by the extending teeth 50. The gear teeth 54 would interlock with the extending teeth 50 forcing the extending pawl 28 to move into the channel sidewall 24. This occurs as the substantially planar side edge of the extending teeth 50 engage to the substantially planar gear teeth 54. Opposite rotation of the knife blade 12 would allow the gear teeth 54 to slip over the extending teeth 50, in a ratcheting mechanism, as explained further herein.

Figure 21:
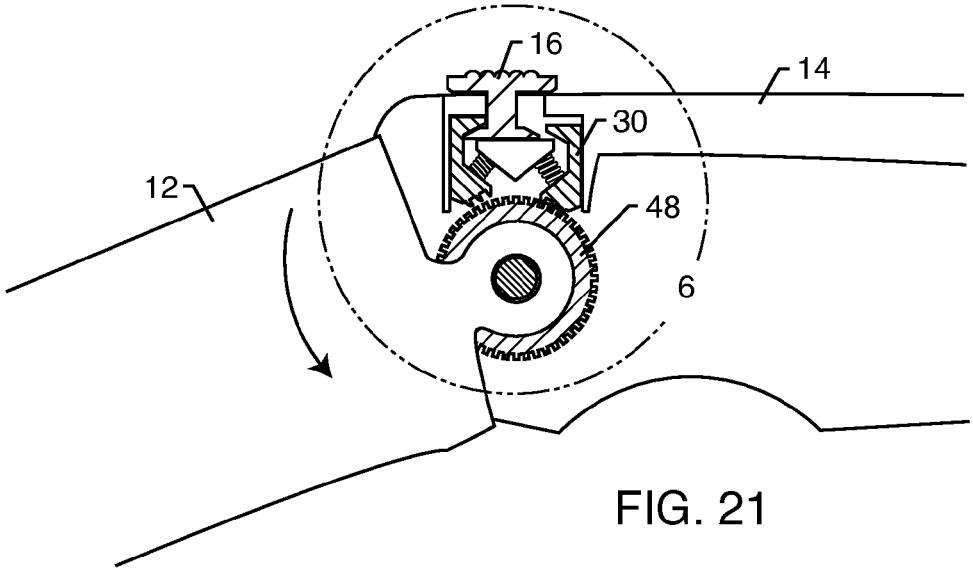
FIG. 21 is a side view of a ratcheting mechanism illustrating engagement to the knife blade for permitting rotation to a stored position.
Figure 22:
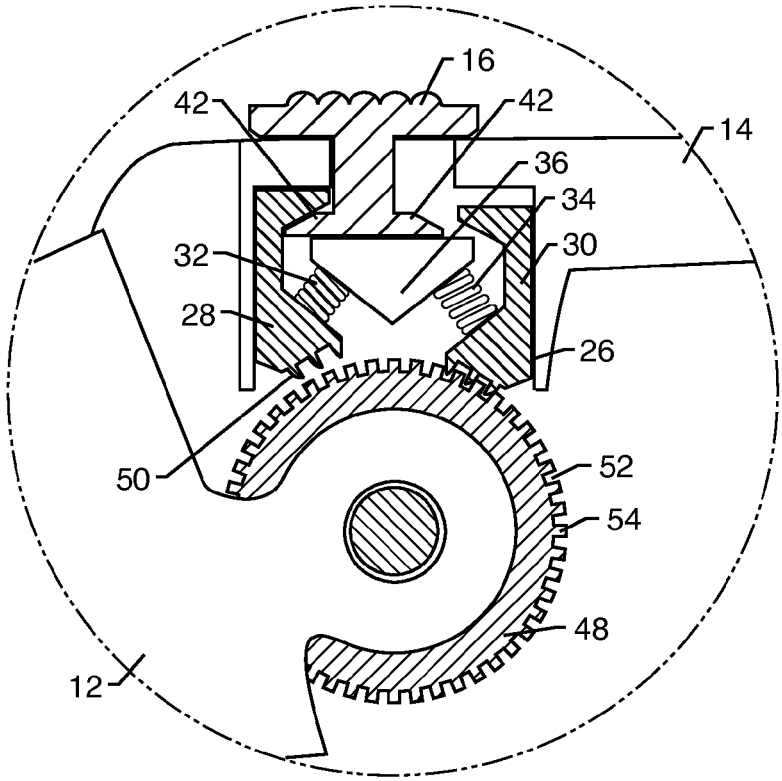
FIG. 22 is an enlarged side view of the ratcheting mechanism taken about circle 6 in FIG. 21.

FIG. 21 generally illustrates engagement of the retracting pawl 30 with the gear 48 in order to allow the knife blade 12 to retract from the extended position into a retracted position. As shown in FIG. 22, the angled feet 42 of the activation slider 16 engage the angled receptor 44 of the extending pawl 28. This causes the extending pawl 28 to extend up into the chamber 22 such that the extending teeth 50 are no longer engaged with the gear 48. Accordingly, the extending pawl 28 compresses the first spring 32 against the base 36. With the movement of the activation slider 16 into the position shown in FIG. 22, the retracting pawl 30 becomes no longer engaged with the angled feet 42 and is thereby pushed downwardly by the second spring 34 such that a set of retracting teeth 56 engage the notches 52 and the corresponding gear teeth 54 of the gear 48 formed in the knife blade 12.

Clockwise rotation of the knife blade 12, to pivot the knife blade 12 from a retracted position to an extended position, is unfeasible as the substantially planar gear teeth 54 contact and engage the substantially planar side of the retracting teeth 56. This engagement forces the retracting pawl 30 to be further biased against the sidewall 26 to effectively prevent any rotation therein. Accordingly, the retracting pawl 30 only allows counter-clockwise rotation of the knife blade 12 from the extended position to a retracted position. Upon rotating the knife blade 12 counter-clockwise in accordance with the arrow shown in FIG. 21, the curved side of the retracting teeth 56 slip over the gear teeth 54 as the retracting pawl 30 is allowed to move up and down against the second spring 34. Positioning the activation slider 16 as shown in FIGS. 21 and 22 only allows counter-clockwise rotation of the knife blade 12 toward a retracted position.

Figure 23:
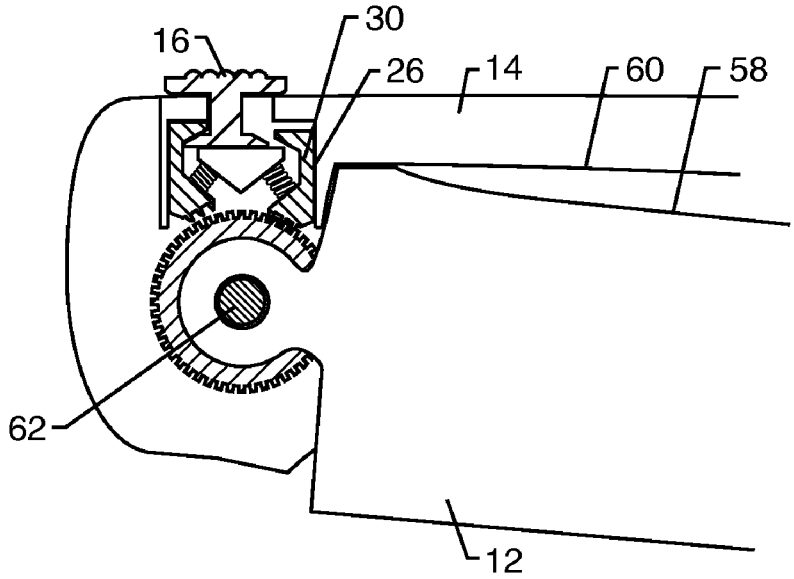
FIG. 23 illustrates a knife blade locked in a fully stored position by a ratcheting mechanism.

FIG. 23 illustrates the knife blade 12 in a fully retracted position such that a cutting side 58 is positioned within the handle housing 14 and preferably buttressed against a backbone 60 of the handle housing 14. The knife blade 12 is rotated about an axis 62 when pivoting from the extended position (FIGS. 19 and 20) to the retracted position as shown in FIG. 23. As the knife blade 12 is rotated from the extended position to the retracted position, the retracting teeth 56 ratchet relative to the gear teeth 54. Thus, when the knife blade 12 is nested within the handle housing 14 and the activation slider 16 is in the position shown in FIG. 23, the knife blade 12 cannot be pivoted clockwise against the retracting pawl 30. As previously described, the gear teeth 54 would engage a planar side of the retracting teeth 56 and effectively push the retracting pawl 30 into the sidewall 26 to prevent any rotational movement therein.

Figure 24:
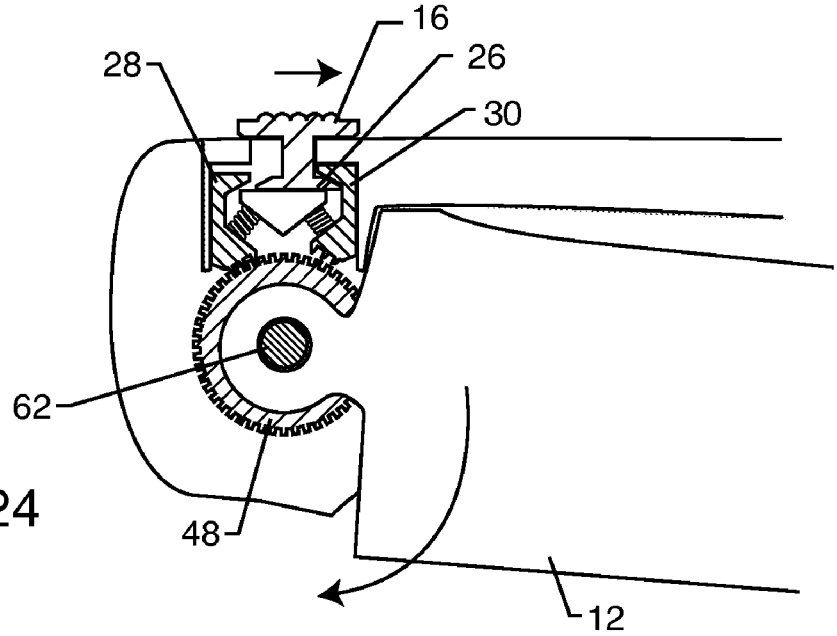
FIG. 24 is a side view of a ratcheting mechanism illustrating rotation of the knife blade from a stored position to an extended position.

To release the knife blade 12 from within the handle housing 14, the activation slider 16 must be moved back to the position shown in FIG. 19 such that the angled feet 42 engage the angled receptor 46 of the retracting pawl 30. As shown in FIG. 24, the activation slider 16 disengages the extending pawl 28 and re-engages the angled receptor 46 of the retracting pawl 30. Again, the extending pawl 28 engages the gear 48 of the knife blade 12 to allow rotation of the knife blade 12 about the axis 62 from the retracted position to an extended position.

Figure 25:
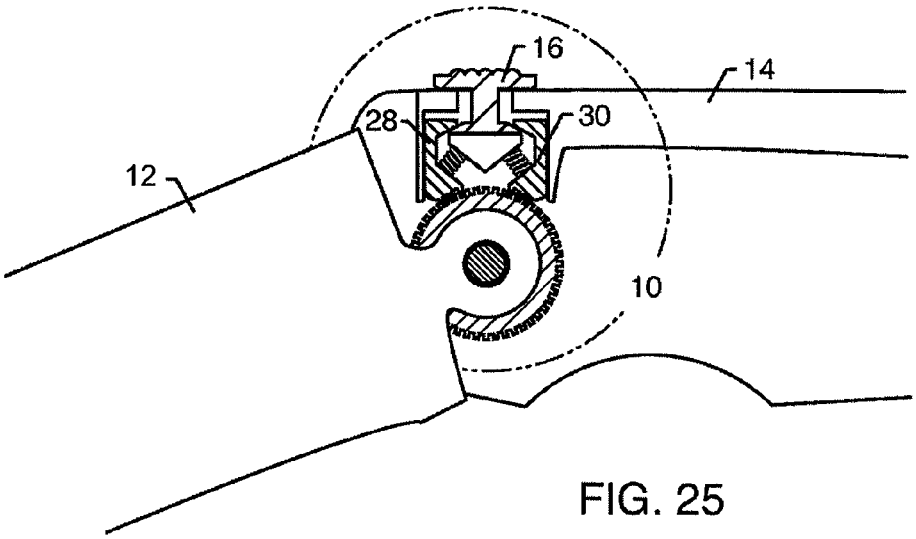
FIG. 25 is a side view of a ratcheting mechanism illustrating locking a knife blade at an angle relative to a handle.
Figure 26:
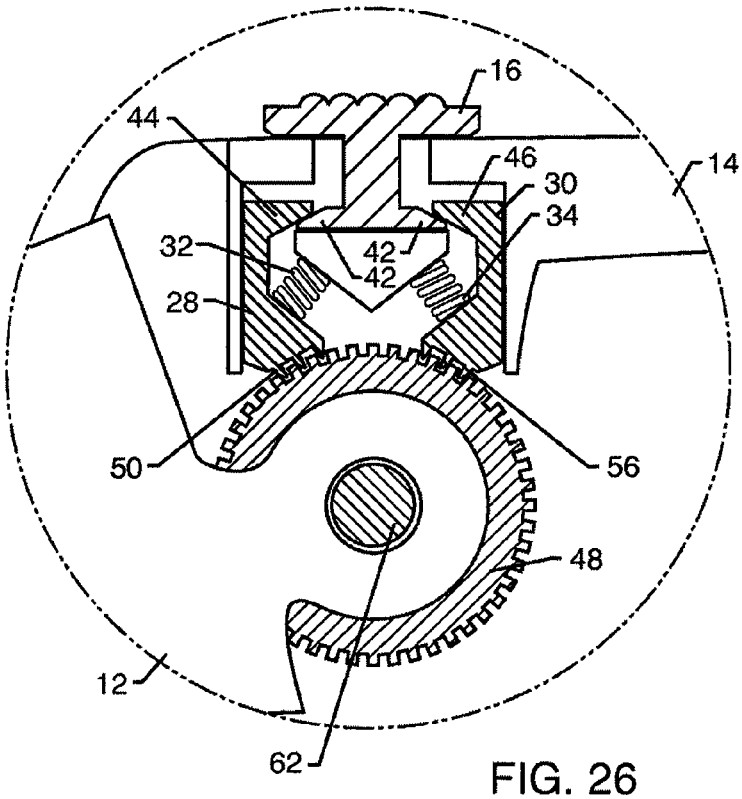
FIG. 26 is an enlarged side view of a ratcheting mechanism taken about the circle 10 in FIG. 25.

In another aspect of the present invention, the activation slider 16 can be positioned intermittent to the extending pawl 28 and the retracting pawl 30 such that the angled feet 42 do not engage either the angled receptors 44, 46. As shown in FIG. 25 and also in FIG. 26, both of the pawls 28, 30 engage the gear 48 of the knife blade 12. Both of the springs 32, 34 bias the pawls 28, 30, respectively, downward and into engagement with the gear 48. Accordingly, the knife blade 12 is unable to rotate either clockwise or counter-clockwise by virtue of being engaged with the extending teeth 50 and the retracting teeth 56 simultaneously.

This particular aspect of the present disclosure allows a user to lock the knife blade 12 in any one of a plurality of angled positions relative to the handle housing 14. In effect, the activation slider 16 between the pawls 28, 30 is like having a ratchet wrench locked on both positions at the same time. This blocks rotation of the knife blade 12 in either direction. Hence, the knife blade 12 is firmly fixed relative to the handle housing 14. Positioning the knife blade 12 at angled intervals relative to the handle housing 14 is particularly useful when used as a carpet knife or when a large angle is preferred between the handle housing 14 and the knife blade 12.

Also provided herein is a method of using a tool of the disclosure. The method includes obtaining a tool, e.g., a knife, of the disclosure, as described above. The method further includes moving the thumb-switch of the knife from a close or neutral lock position to an open position. Once the thumb-switch is in the open position, the knife may then be opened. The knife may be opened by exerting a sufficient force in a sufficient direction on the knife blade so as to cause the knife blade to rotate relative the handle portion. Once opened to the desired angle, the knife blade may then be locked in place by moving the thumb-switch from the open position to the lock position. The knife may then be used. Although the knife does not need to be in the locked position to be used, for greater safety it is suggested that the knife blade be locked before use. After the knife has been opened and/or used, the knife may be closed. The knife may be closed by moving the thumb-switch from the open or locked position to the close position. Once the thumb-switch has been moved into the close position, the knife blade may be rotated backward so as to be received within the housing of the handle portion. The knife blade will not be capable of being opened while the thumb-switch is in this position, but if desired, the thumb-switch may then be moved into the locked position. The knife may then be stored for future use as desired.

Further provided herein is a specialized packaging that may be used to display a tool of the disclosure. The specialized packaging includes a container, wherein the container includes one or more of a tool of the disclosure and an excerpt describing the tool and/or its use. The packaging may additionally include instructions as to the use of the tool. Further, the container may be configured so as to allow a thumb-switch of a packaged tool of the disclosure to be moved from one position to another (e.g., moved back and/or forth from a close, neutral, and open position). The container may be configured for allowing a working portion of the packaged tool to be moved from one or more of a closed position to a semi-open to an open position. Accordingly, in such an exemplified manner, a tool of the disclosure may be packaged within a container, and yet the components of the tool may still be manipulated so as to open and/or lock and/or close the tool.

Figure 27:
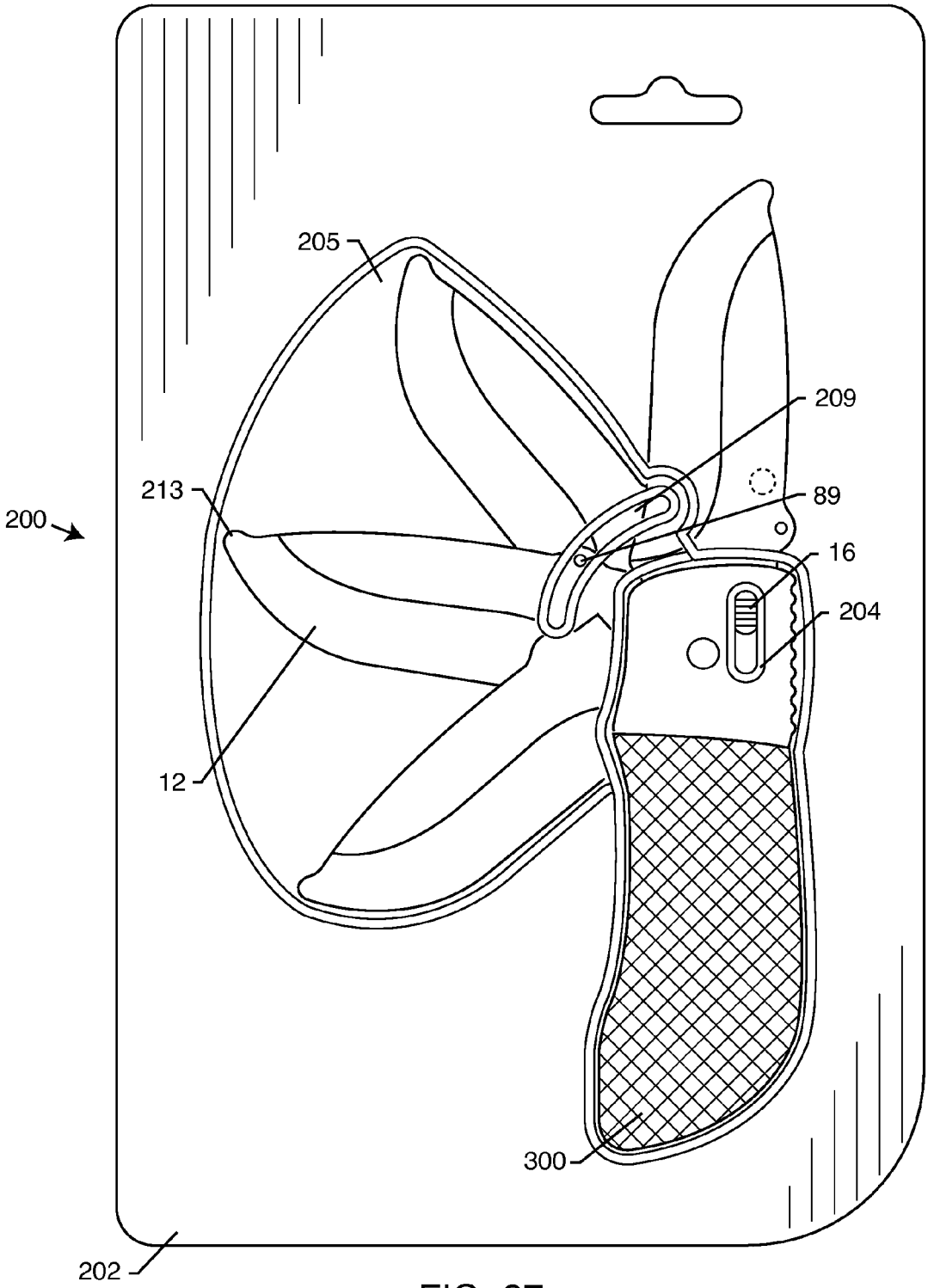
FIG. 27 shows a packaging including a knife of the disclosure.

Specifically, in certain embodiments, for instance, wherein the tool is a knife, the knife may be packaged within a container, which container allows the thumb-switch to be manipulated and/or which container allows the blade to be opened, and/or closed, and/or locked in place. For example, as can be seen with reference to FIG. 27, the packaging 200 includes a container 202, wherein the container is configured for containing a tool 300. Accordingly, the container includes a tool cavity adapted for receiving a tool 300 therein. The container 202 may include a cavity for allowing a portion of the tool 300 to be manipulated and/or extended. For instance, the packaging 202 may include a cavity 205 for allowing the blade 12 to extend and/or rotate within the container 202 while at the same time being displayed within the packaging 200. In certain embodiments, the container 202 includes an opening 204 for allowing a switch 16 of the tool 300 to be manipulated. For instance, the container 202 may include a thumb-switch opening 204 that is configured for allowing the thumb-switch 16 of a packaged tool 300 to be manipulated, as described above. As depicted, when the thumb switch 16 is appropriately manipulated through the container 202, a blade 12 positioned in the blade cavity 205 may be allowed to move, e.g., may be rotated while in the packaging 200. The container may include an opening 209 for allowing a blade post 89 to be engaged, which blade post 89 facilitates the movement of the blade 12 while in the packaging 200. Accordingly, the container 202 may include a blade post opening 209. The packaging may additionally include a blade cover 213 for covering the blade while within the container 202, e.g., for increased safety.

All publications and patents cited in this specification are herein incorporated by reference as if each individual publication or patent were specifically and individually indicated to be incorporated by reference.

While the invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the invention. All such modifications are intended to be within the scope of the claims appended hereto.

What is claimed is:

1. A tool, comprising:

a blade, comprising a distal portion and a proximal portion, wherein the proximal portion comprises a blade hub having a plurality of teeth formed on an outer surface thereof; and a blade holder comprising a first engagement element and an opposing second engagement element, the engagement elements having mating teeth that are configured to engage the teeth on the outer surface of the blade hub; wherein the blade is pivotable in a first direction relative to the blade holder when the mating teeth of the first engagement element are engaged with the teeth of the blade hub; wherein the blade is pivotable in an opposite direction when the mating teeth of the second engagement element are engaged with the teeth of the blade hub; and wherein the blade is substantially prevented from moving relative to the blade holder when the mating teeth of the engagement elements are engaged with the teeth of the blade hub.

2. The tool according to claim 1, wherein the plurality of teeth are configured for engaging the mating teeth sequentially so as to produce a sequential engagement.

3. The tool according to claim 2, wherein said sequential engagement produces incremental movement as the blade is moved relative to the blade holder.

4. The tool according to claim 3, wherein said incremental movement comprises rotational movement.

5. The tool according to claim 1, wherein the teeth on the blade hub and the mating teeth on the blade holder form a ratchet element.

6. The tool according to claim 1, wherein the mating teeth on the first or second engagement element comprise a pawl.

7. The tool according to claim 1, wherein the blade holder further comprises an engagement element holder.

8. The tool according to claim 7, wherein the engagement element holder comprises a pawl holder.

9. The tool according to claim 8, wherein the pawl holder comprises a pawl pocket.

10. The tool according to claim 9, wherein the pawl pocket comprises one or more arcs.

11. The tool according to claim 10, wherein the one or more arcs are symmetrical.

12. The tool according to claim 10, wherein the one or more arcs are non-symmetrical.

13. The tool according to claim 10, wherein the one or more arcs comprise a different degree of curvature.

14. The tool according to claim 10, wherein the pawl pocket includes one or more springs.

15. The tool according to claim 14, wherein the one or more springs engages at least one of the engagement elements.

16. The tool according to claim 14, wherein the one or more springs engages the engagement elements.

17. A tool comprising:

a blade, wherein an end of the blade includes a plurality of teeth on an outer surface thereof;

a blade holder that is attached to the end of the blade, wherein the blade holder includes a lock mechanism, which comprises a first engagement element and a second engagement element, each engagement element having mating teeth that are configured to be engaged with the teeth on the blade in order to control the rotation of the blade relative to the blade holder, and wherein the lock mechanism further includes a slidable button movable between a forward position, a neutral position and a back position, wherein the slidable button in the forward position allows the mating teeth of the first engagement element to engage the teeth of the blade to rotate the blade in one direction and the slidable button in the back position allows the mating teeth of the second engagement element to engage the teeth of the blade to rotate the blade in an opposite direction and the slidable button in the neutral position prevents the blade from rotating in either direction by allowing the mating teeth of the engagement elements to engage the teeth of the blade.

* * * * *